US010385743B2

(12) United States Patent
Takai

(10) Patent No.: US 10,385,743 B2
(45) Date of Patent: Aug. 20, 2019

(54) OIL SEPARATOR

(71) Applicant: NIFCO INC., Yokosuka-shi (Kanagawa) (JP)

(72) Inventor: Motoharu Takai, Yokosuka (JP)

(73) Assignee: NIFCO INC. (JP)

( * ) Notice: Subject to any disclaimer, the term of this patent is extended or adjusted under 35 U.S.C. 154(b) by 94 days.

(21) Appl. No.: 15/105,390

(22) PCT Filed: Dec. 5, 2014

(86) PCT No.: PCT/JP2014/082324
§ 371 (c)(1),
(2) Date: Jun. 16, 2016

(87) PCT Pub. No.: WO2015/093327
PCT Pub. Date: Jun. 25, 2015

(65) Prior Publication Data

US 2016/0312672 A1 Oct. 27, 2016

(30) Foreign Application Priority Data

Dec. 20, 2013 (JP) ..... 2013-264479

(51) Int. Cl.
*F01M 13/04* (2006.01)

(52) U.S. Cl.
CPC ..... *F01M 13/04* (2013.01); *F01M 13/0416* (2013.01); *F01M 2013/0433* (2013.01)

(58) Field of Classification Search
CPC ..... F01M 13/04; F01M 13/0416; F01M 2013/0433
See application file for complete search history.

(56) References Cited

U.S. PATENT DOCUMENTS 6,412,478 B1 * 7/2002 Ruehlow ..... F01M 13/0416 123/41.86
7,678,169 B1 * 3/2010 Gwin ..... B01D 45/06 123/41.86

(Continued)

FOREIGN PATENT DOCUMENTS

DE 10 2007 062 098 A1 6/2009
EP 1062162 12/2000

(Continued)

OTHER PUBLICATIONS

Extended European Search Report dated Aug. 11, 2017 for corresponding European Application No. 14870727.6.

(Continued)

*Primary Examiner* — Joseph J Dallo
*Assistant Examiner* — Kurt Philip Liethen
(74) *Attorney, Agent, or Firm* — Thomas|Horstemeyer, LLP

(57) ABSTRACT

An oil separator includes: an oil separator main body that is formed with a gas flow path between a gas introduction port that introduces blow-by gas and a gas discharge port that discharges the blow-by gas; a flap that opens and closes the gas flow path, and that includes a substantially circular shaped valve section including a straight line portion of a substantially straight line shape at a portion of an outer periphery of the valve section; and a first impact wall for capturing oil, that is provided along the outer periphery of the valve section at a downstream side of the valve section in the gas flow path, that includes a straight line portion of a substantially straight line shape along the straight line portion of the valve section, and that is impacted by the blow-by gas flowing out from a peripheral edge of the valve section.

16 Claims, 6 Drawing Sheets

(56) References Cited

U.S. PATENT DOCUMENTS

| | | | | |
|---|---|---|---|---|
| 8,485,164 | B2 | 7/2013 | Ruppel et al. | |
| 2001/0025633 | A1 | 10/2001 | Takada et al. | |
| 2002/0083934 | A1 | 7/2002 | Ruehlow et al. | |
| 2004/0261776 | A1* | 12/2004 | Knaus | F01M 13/022 123/572 |
| 2008/0105494 | A1* | 5/2008 | Lemke | F01M 13/0011 184/6.23 |
| 2009/0301449 | A1* | 12/2009 | Ogawa | F01M 13/022 123/574 |
| 2011/0036242 | A1* | 2/2011 | Enderich | B01D 45/04 96/400 |
| 2015/0354420 | A1* | 12/2015 | Kira | F02F 7/006 123/574 |

FOREIGN PATENT DOCUMENTS

| | | |
|---|---|---|
| JP | 201147354 | 3/2011 |
| JP | 2012036802 | 2/2012 |
| JP | 2012255451 | 12/2012 |

OTHER PUBLICATIONS

International Search Report and Written Opinion of Application No. PCT/JP2014/082324 dated Feb. 10, 2015.

* cited by examiner

OIL SEPARATOR

CROSS-REFERENCE TO RELATED APPLICATIONS

This application is the National Stage of International Application No. PCT/JP2014/082324, filed 5 Dec. 2014, having the title "OIL SEPARATOR" which claims the benefit of and priority to Japanese Application No. 2013-264479, filed on 20 Dec. 2013, the contents of all of which are incorporated by reference as if fully set forth herein.

TECHNICAL FIELD

The present invention relates to an oil separator, and relates in particular to an oil separator that traps oil mist contained in blow-by gas generated inside an engine crankcase of an internal combustion engine such as an automobile engine.

BACKGROUND ART

An oil separator described in the specification of European Patent (EP) No. 1062162, for example, is known as this conventional type of oil separator. This oil separator includes a wall portion that is at a downstream side of a circular shaped elastic tongue piece (flap), attached to a flow path of the blow-by gas in a cantilevered state, and that runs along an outer periphery of the elastic tongue piece. Oil mist contained in the blow-by gas can be captured by a slight loss in pressure due to the blow-by gas that has pressed open and flowed past the elastic tongue piece striking the wall portion.

SUMMARY OF INVENTION

Technical Problem

However, in the oil separator described in the specification of EP. No. 1062162, an outer peripheral portion of the elastic tongue piece which the blow-by gas passes is configured in a circular arc shape, and the wall portion is also formed in a circular arc shape along the outer periphery of the elastic tongue piece. Thus, even if the wall portion is designed to secure a minimum flow path cross-sectional area required in order for the blow-by gas to pass through, and to be at the closest position to the outer periphery of the elastic tongue piece, the blow-by gas that has passed the outer periphery of the elastic tongue piece is dispersed in a radiating shape in the peripheral direction of the circular arc, such that the flow speed of the blow-by gas prior to striking the wall portion is reduced. There is accordingly a reduction in efficiency in capturing oil mist.

In consideration of the above circumstances, an object of the present invention is to obtain an oil separator capable of improving performance in capturing oil mist.

Solution to Problem

An oil separator of a first aspect of the present invention includes: an oil separator main body that is formed with a gas flow path between a gas introduction port that introduces blow-by gas and a gas discharge port that discharges the blow-by gas; a flap that is provided extending along a direction orthogonal to the gas flow path, that opens and closes the gas flow path, and that includes a substantially circular shaped valve section including a straight line portion of a substantially straight line shape at a portion of an outer periphery of the valve section; and a first impact wall for capturing oil, that is provided along the outer periphery of the valve section at a downstream side of the valve section in the gas flow path, that includes a straight line portion of a substantially straight line shape along the straight line portion of the valve section, and that is impacted by the blow-by gas flowing out from a peripheral edge of the valve section.

In the oil separator of the first aspect, blow-by gas that has been introduced through the gas introduction port of the oil separator main body flows into the gas flow path formed between the gas introduction port and the gas discharge port. The blow-by gas (hereafter referred to as "flow of gas") presses open and flows past the valve section of the flap provided extending along a direction orthogonal to the gas flow path, and hits the first impact wall provided at the outer periphery of the valve section at the downstream side of the valve section of the flap, such that oil (oil in mist form) is captured. The valve section of the flap has a substantially circular shape including the straight line portion of substantially straight line shape at a portion of the outer periphery of the valve section, and a portion of the first impact wall is the straight line portion that is of substantially straight line shape along the straight line portion of the valve section. Thus, the flow of gas that has passed the straight line portion at the outer periphery of the valve section of the flap flows toward the straight line portion of the opposing first impact wall without being dispersed in the peripheral direction of a circular arc portion, unlike the flow of gas at a circular arc portion, thereby enabling a reduction in the flow speed of the blow-by gas prior to striking the straight line portion of the first impact wall to be suppressed. Thus, the blow-by gas for which a reduction in flow speed has been suppressed strikes the location of the first impact wall that is of substantially straight line shape (the straight line portion), thereby improving performance in capturing oil mist.

An oil separator of a second aspect of the present invention is the oil separator of the first aspect, wherein a fixing section for fixing the flap to the gas flow path is formed at a location at an opposite side of the flap from the straight line portion.

In the oil separator of the second aspect, when the valve section of the flap has been pressed open by the flow of gas, the location of the valve section at the opposite side of the flap from the fixing section opens wider than other locations, such that the flow of gas is greater than at other locations. Thus, efficiency in capturing oil mist is further improved by having the straight line portion of the valve section of the flap at the location at the opposite side to the fixing section of the flap.

An oil separator of a third aspect of the present invention is the oil separator of the second aspect, wherein the valve section and the fixing section are coupled together by two coupling sections that project out from the valve section toward the fixing section and that are separated along an outer peripheral direction of the valve section, and a second impact wall is formed in a substantially straight line shape at a location corresponding to somewhere between the two coupling sections.

In the oil separator of the third aspect, when the valve section of the flap has been pressed open by the flow of gas, the flow of gas flows out between the two coupling sections that couple the valve section and the fixing section together. The flow of gas impacts the second impact wall formed in a substantially straight line shape at a location corresponding to the separation between the two coupling sections, such that oil mist is captured. Thus, performance in capturing oil mist is further improved.

An oil separator of a fourth aspect of the present invention is the oil separator of any one of the first aspect to the third aspect, wherein the valve section of the flap is disposed along a substantially vertical direction, the straight line portion of the first impact wall is disposed along a substantially horizontal direction, and an opening section for discharging captured oil is formed below the first impact wall.

In the oil separator of the fourth aspect, the flow of gas presses open and flows past the valve section of the flap disposed along the substantially vertical direction and hits the straight line portion of the first impact wall disposed along the substantially horizontal direction, such that oil is captured. Oil captured at the first impact wall drops under its own weight and is discharged through the opening section formed below the first impact wall. Recovery of oil is therefore easy.

An oil separator of a fifth aspect of the present invention is the oil separator of any one of the first aspect to the fourth aspect, further including an attachment portion that is formed at an outer peripheral portion of the oil separator main body and that is fixed to an inner portion of an engine head cover.

In the oil separator of the fifth aspect of the present invention, the oil separator can be fixed to the inner portion of the engine head cover by the attachment portion formed to the outer peripheral portion of the oil separator main body. This enables the oil separator to be easily disposed at an inner portion of the engine head cover.

Advantageous Effects of Invention

The oil separator of the first aspect of the present invention has the above configuration, thereby enabling performance in capturing oil mist to be improved.

The oil separator of the second aspect of the present invention has the above configuration, thereby enabling performance in capturing oil mist to be further improved.

The oil separator of the third aspect of the present invention has the above configuration, thereby enabling performance in capturing oil mist to be further improved.

The oil separator of the fourth aspect of the present invention has the above configuration, thereby enabling oil to be easily recovered.

The oil separator of the fifth aspect of the present invention has the above configuration, thereby enabling the oil separator to be easily disposed at an inner portion of the engine head cover.

DESCRIPTION OF EMBODIMENTS

Figure 1:
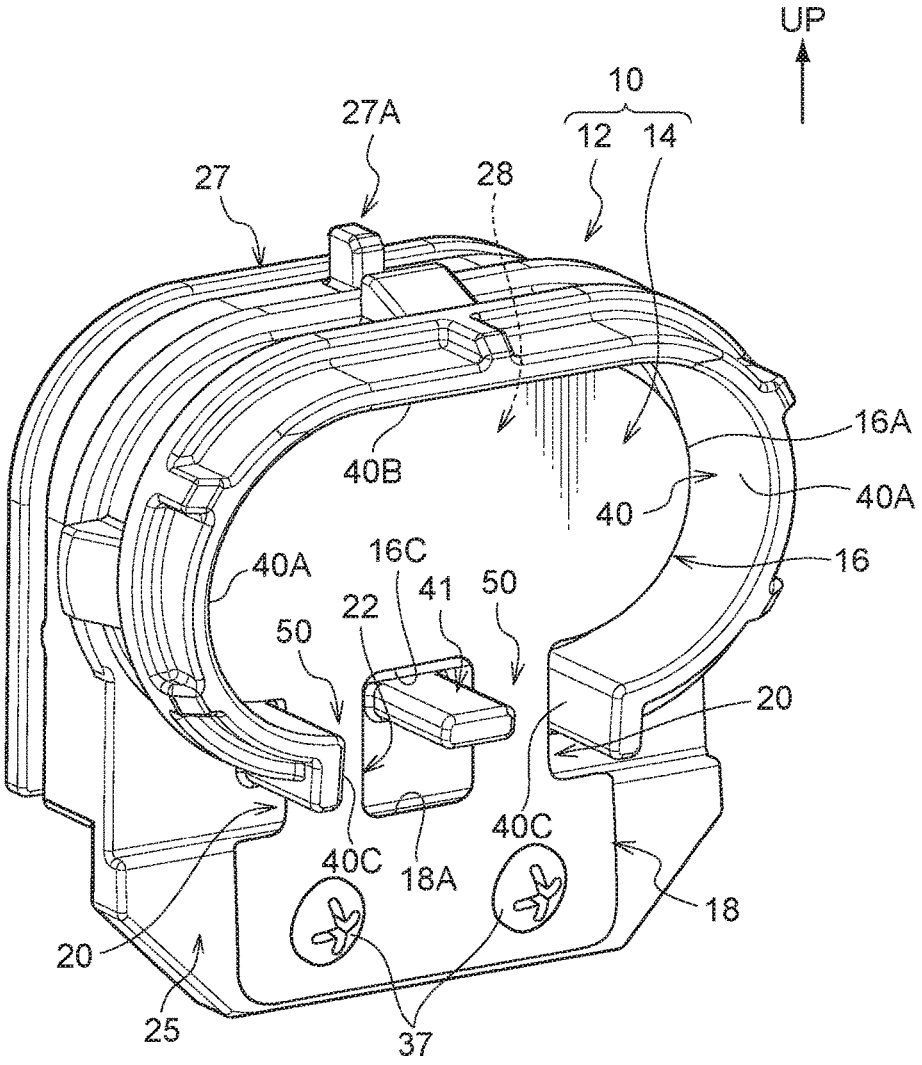
FIG. 1 is a perspective view illustrating an external appearance of an oil separator according to an exemplary embodiment of the present invention.

Explanation follows regarding an oil separator according to an exemplary embodiment of the present invention, with reference to FIG. 1 to FIG. 5. Note that the arrow UP in the drawings indicates the upper direction in a vertical direction, this being the upper side of the oil separator.

As illustrated in FIG. 1, an oil separator 10 of the present exemplary embodiment includes an oil separator main body 12 and a flap 14.

Figure 2:
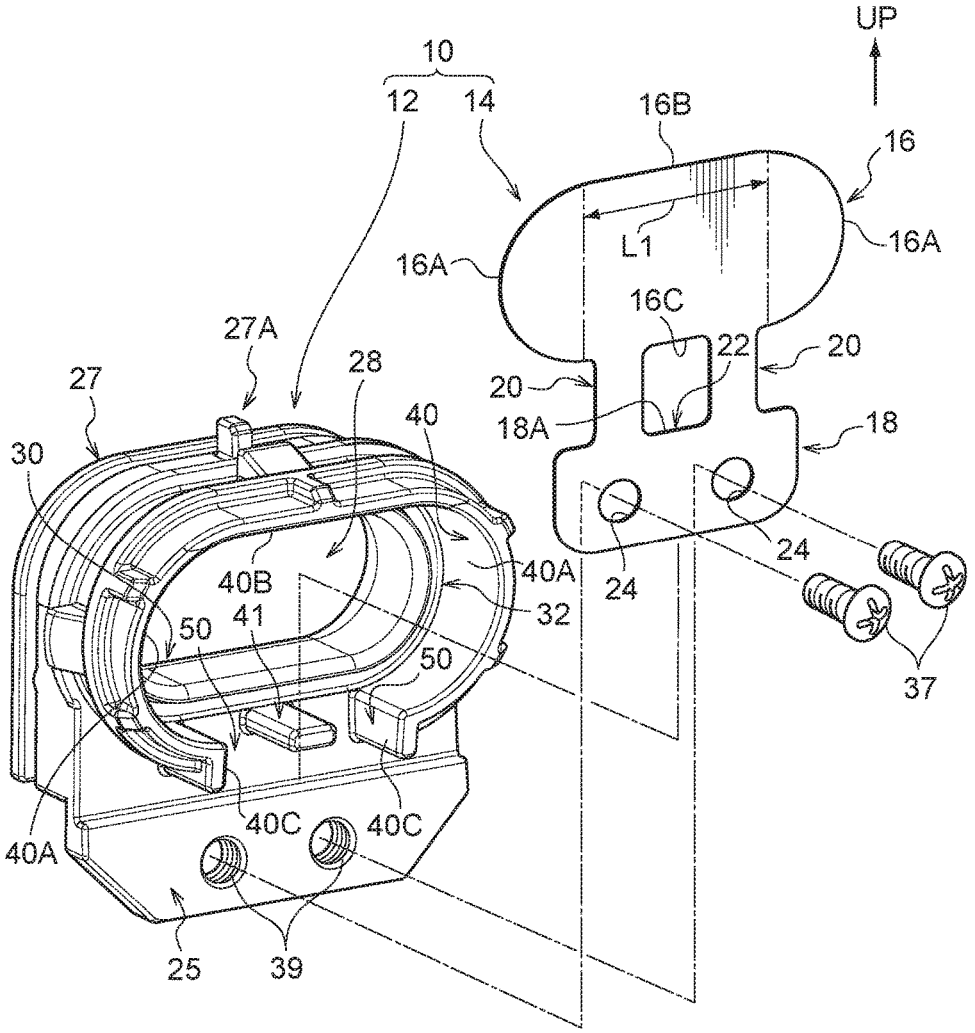
FIG. 2 is an exploded perspective view illustrating an oil separator according to an exemplary embodiment of the present invention.

As illustrated in FIG. 2, as an example, the flap 14 is configured by a thin metal plate, and includes a valve section 16, and a fixing section 18 for fixing the flap 14 to a gas flow path. The valve section 16 and the fixing section 18 are coupled together by coupling sections 20. When the flap 14 undergoes elastic deformation under the pressure of a flow of gas, the valve section 16 is capable of moving between a closed position illustrated by double-dotted dashed lines and an open position illustrated by solid lines in FIG. 5.

Figure 3:
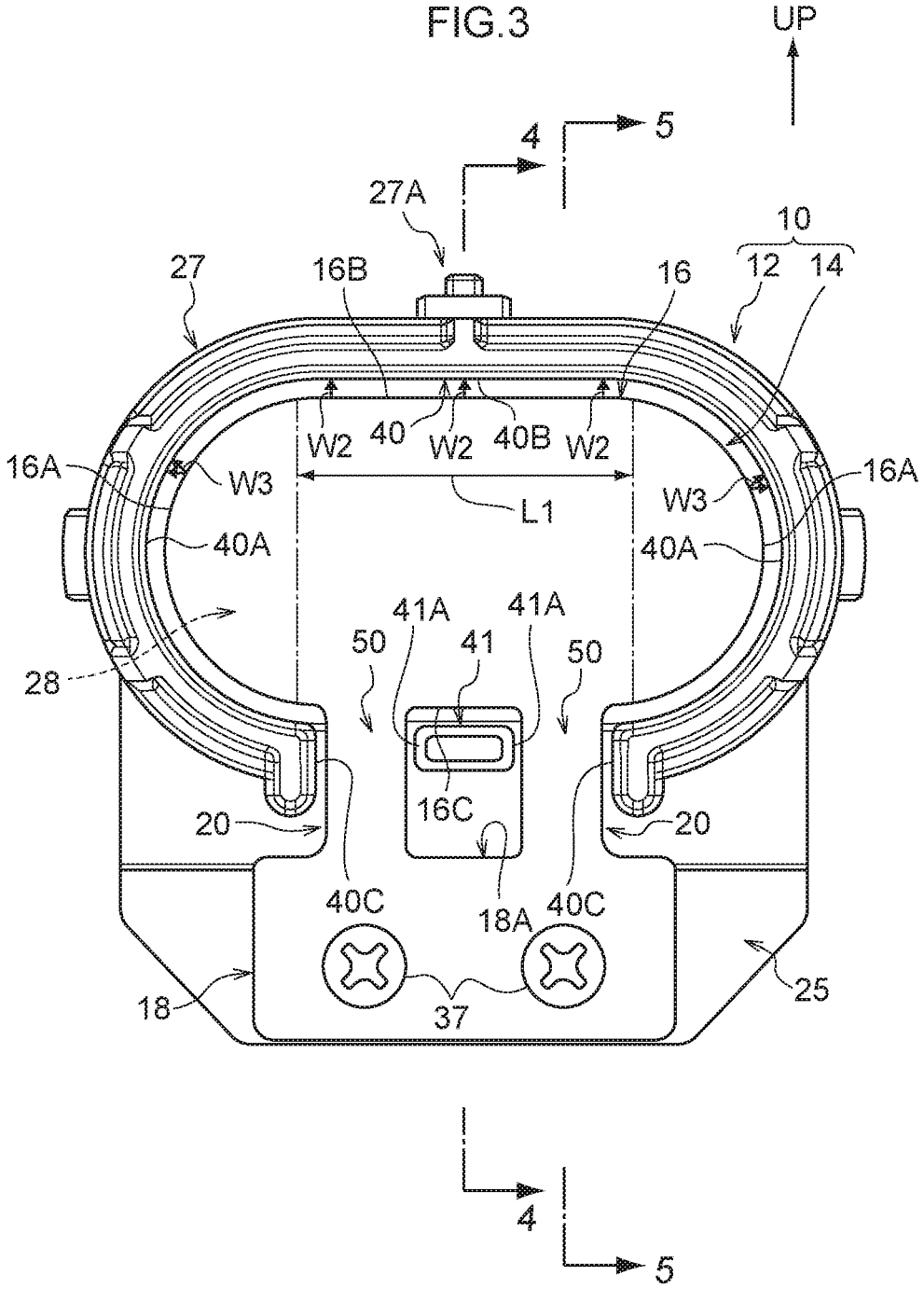
FIG. 3 is a face-on view illustrating an oil separator according to an exemplary embodiment of the present invention.

As illustrated in FIG. 3, the valve section 16 of the flap 14 is configured in a substantially elliptical shape, this being an example of a substantially circular shape with its length direction along the left-right direction, and left and right outer peripheral portions respectively configure semicircular arc portions 16A. A location at an upper side outer peripheral portion between the semicircular arc portions 16A configures a straight line portion 16B in a straight line along the left-right direction, this being the peripheral direction, and L1 is a length of the straight line portion 16B along the left-right direction. An outer peripheral portion at the opposite side of the valve section 16 to the straight line portion 16B configures a straight line portion 16C in a straight line along the left-right direction. The left and right pair of coupling sections 20 are respectively formed projecting downward from the vicinity of both end portions at the left and right of the straight line portion 16C.

As illustrated in FIG. 2, the fixing section 18 of the flap 14 is formed at a location of an outer peripheral portion of the valve section 16 at the opposite side to the straight line portion 16B. The fixing section 18 of the flap 14 is configured in a rectangular shape with its length direction along the left-right direction, and lower ends of the left and right pair of coupling sections 20 are coupled to an upper side outer peripheral portion 18A of the fixing section 18. A rectangular shaped cutout 22 is thereby formed between the left and right pair of coupling sections 20. A pair of circular shaped attachment holes 24 are formed in the fixing section 18 with a specific separation in the left-right direction therebetween.

Figure 4:
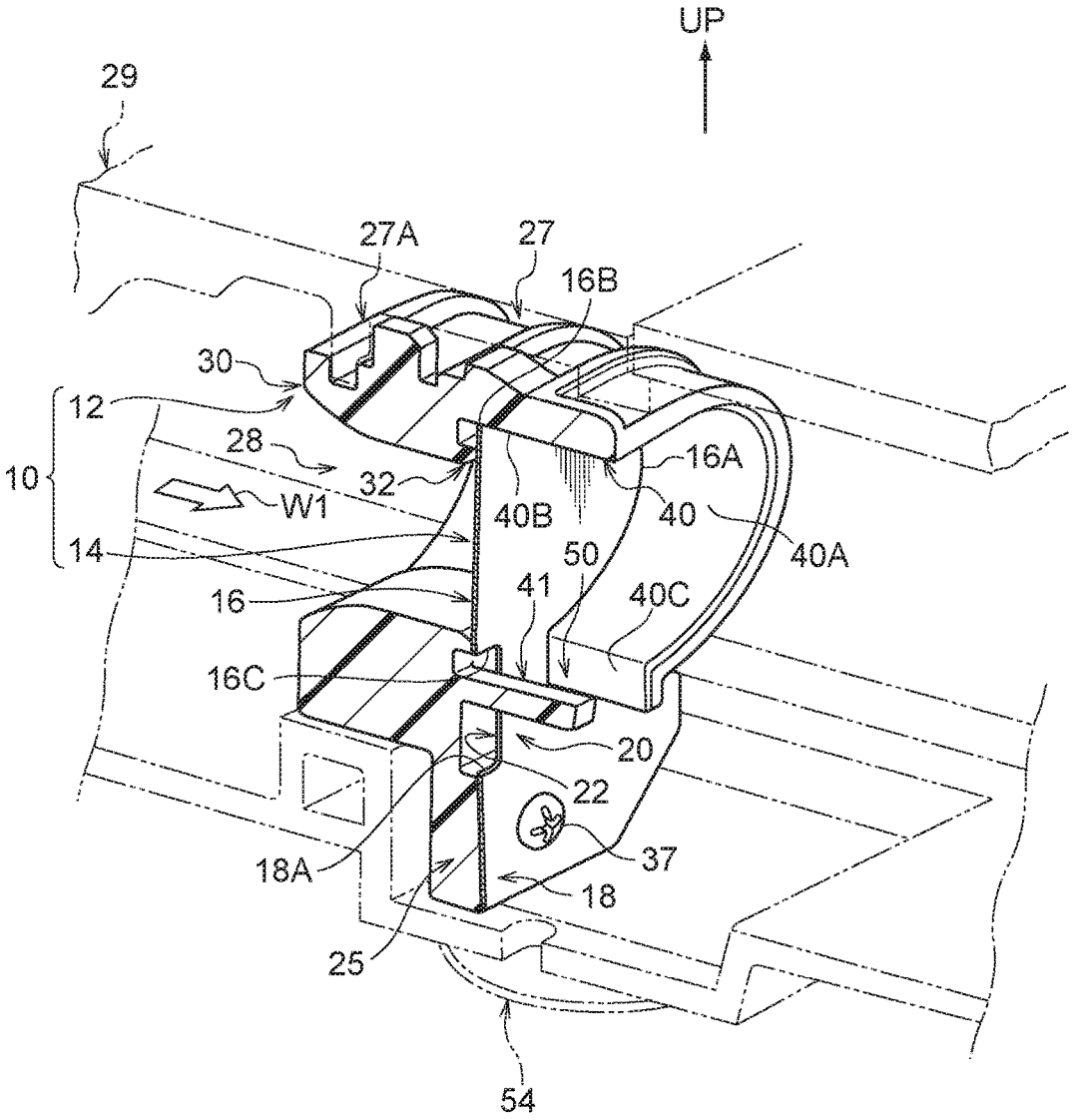
FIG. 4 is a perspective view illustrating part of an oil separator according to an exemplary embodiment of the present invention, sectioned along line 4-4 in FIG. 3.

As illustrated in FIG. 4, the oil separator main body 12 includes a flap fixing section 25 to which the flap 14 is fixed, and a frame section 27 forming a gas flow path 28 through which blow-by gas (the arrow W1 in FIG. 5) flows. An engagement portion 27A, serving as an attachment portion for fixing the oil separator 10 to an inner portion of an engine head cover 29, is formed at an outer peripheral portion of the frame section 27.

Figure 5:
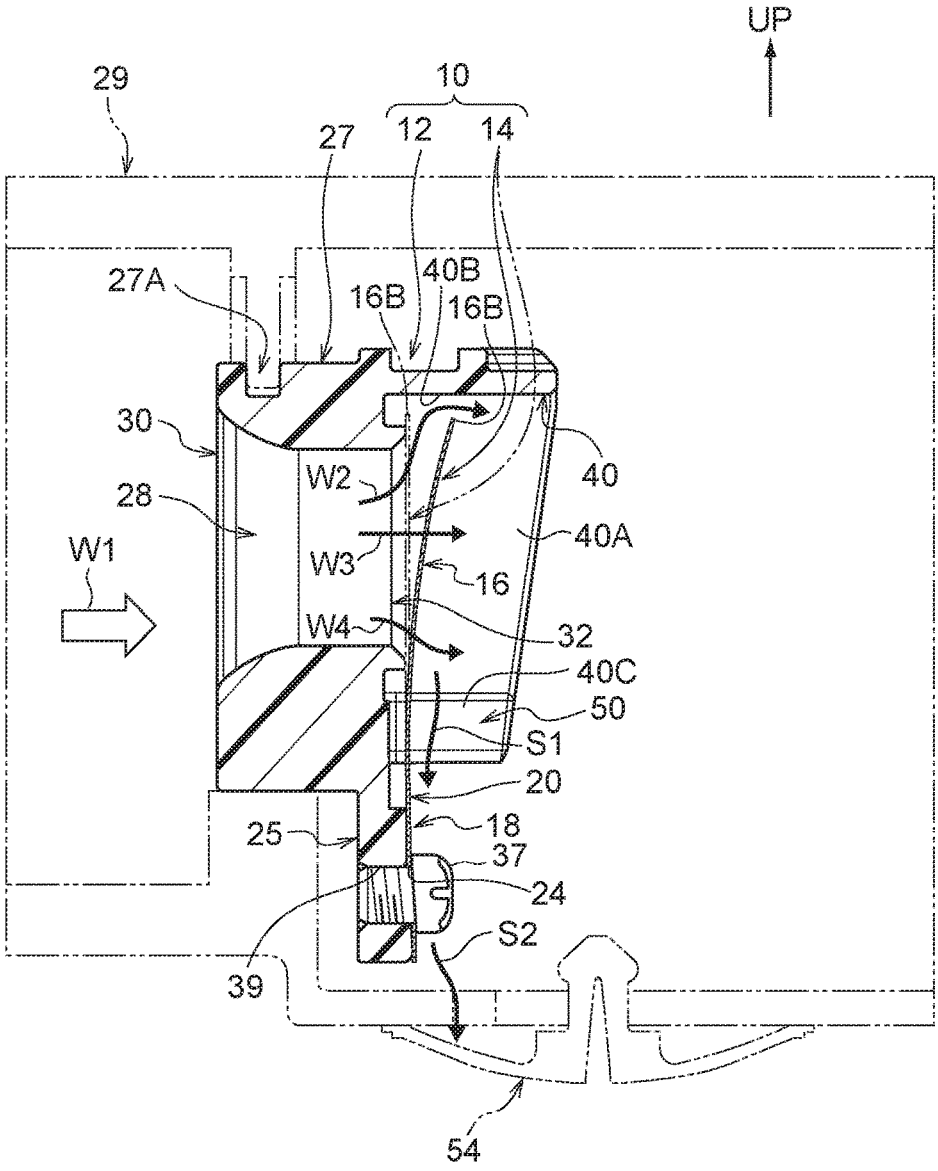
FIG. 5 is a cross-section illustrating an operating state of an oil separator according to an exemplary embodiment of the present invention, sectioned along line 5-5 in FIG. 3.

As illustrated in FIG. 5, the gas flow path 28 of the oil separator main body 12 is formed in a straight line between a gas introduction port 30 for introducing blow-by gas and a gas discharge port 32 for discharging blow-by gas, and an outer peripheral portion of the gas flow path 28 configures the frame section 27. The flap fixing section 25 of the oil separator main body 12 is formed projecting out at the lower side of the frame section 27 of the oil separator main body 12.

As illustrated in FIG. 2, a pair of attachment holes 39 are formed in the flap fixing section 25 with a specific separation in the left-right direction therebetween. The flap 14 is fixed to the oil separator main body 12 by passing fixing members such as screws 37 through the attachment holes 24 and the attachment holes 39 and fastening to female thread portions formed in the attachment holes 39 in a state in which the fixing section 18 of the flap 14 has abutted the flap fixing section 25.

As illustrated in FIG. 4, an impact wall 40 is formed projecting toward a downstream direction (the right direction in FIG. 5) at the downstream side of the flap 14 in the gas flow path 28 of the oil separator main body 12. Note that "downstream" in the present exemplary embodiment refers to downstream in the direction in which the blow-by gas flows.

As illustrated in FIG. 3, the impact wall 40 of the oil separator main body 12 is provided along the outer periphery of the valve section 16 of the flap 14. To explain more specifically, the impact wall 40 is configured in a substantially elliptical shape with its length direction along the left-right direction, and left and right outer peripheral portions configure semicircular arc portions 40A. A location at an upper side outer peripheral portion between the semicircular arc portions 40A configures a straight line portion 40B in a straight line, and L1 is the length of the straight line portion 40B along the left-right direction. An impact wall 41 is formed at a left-right direction central portion at a location facing the straight line portion 40B of the impact wall 40. The impact wall 41 extends in a straight line in the left-right direction along the straight line portion 16C of the valve section 16, and passes through the cutout 22 of the flap 14. Note that the impact wall 40 of the present exemplary embodiment is an example of a first impact wall of the present invention, and the impact wall 41 of the present exemplary embodiment is an example of a second impact wall of the present invention.

Thus, as illustrated in FIG. 5, the flow of gas (the arrow W1 in FIG. 5) presses open and flows, as illustrated by the solid lines in FIG. 5, through the valve section 16 of the flap 14 provided extending along a direction orthogonal to the gas flow path 28. When this occurs, the flow of gas (the arrows W2 to W4 in FIG. 5) hits the impact wall 40 and the impact wall 41 provided along the outer peripheral portion of the valve section 16 at the downstream side of the valve section 16 of the flap 14, such that oil is captured. Blow-by gas that has passed the straight line portion 16B at the outer periphery of the valve section 16 of the flap 14 (the arrow W2 in FIG. 5) flows toward the opposing straight line portion 40B of the impact wall 40, without being dispersed in the peripheral direction of the semicircular arc portions 40A, unlike the flow of gas at the semicircular arc portions 40A (the arrow W3 in FIG. 5).

Note that in the present exemplary embodiment, the valve section 16 of the flap 14 is disposed along the vertical direction, and the straight line portion 40B of the impact wall 40 and the impact wall 41 are disposed along the horizontal direction.

As illustrated in FIG. 3, opening sections 50 for discharging captured oil are formed below the impact wall 40 and the impact wall 41 in the oil separator main body 12. To explain more specifically, a left and right pair of the opening sections 50 for discharging captured oil from the oil separator main body 12 are respectively formed between both left-right direction ends 41A of the impact wall 41 and peripheral direction end portions 40C of the impact wall 40, the peripheral direction end portions 40C of the impact wall 40 being provided extending downward. The coupling sections 20 of the flap 14 pass through the opening sections 50.

Thus, as illustrated by the arrow S1 in FIG. 5, oil that has pooled at inner peripheral portions of the impact wall 40 and the impact wall 41 of the oil separator 10 passes through the opening sections 50 and is discharged from the oil separator main body 12, and is then recovered through a drain valve 54 as illustrated by the arrow S2.

Operation and Advantageous Effects

Explanation follows regarding operation and advantageous effects of the present exemplary embodiment.

In the oil separator 10 of the present exemplary embodiment, as illustrated in FIG. 5, blow-by gas that has been introduced to an inner portion of the oil separator main body 12 through the gas introduction port 30 (the arrow W1 in FIG. 5) flows into the gas flow path 28 formed between the gas introduction port 30 and the gas discharge port 32. The flow of gas presses open and flows, as illustrated by the solid lines in FIG. 5, through the valve section 16 of the flap 14 provided extending along a direction orthogonal to the gas flow path 28, and hits the impact wall 40 provided along the outer periphery of the valve section 16 at the downstream side of the valve section 16 of the flap 14, such that oil that has formed water droplets is captured.

In the present exemplary embodiment, a portion of the outer periphery of the valve section 16 of the flap 14 includes the straight line portion 16B in a straight line, and the straight line portion 40B of the impact wall 40 is provided along the straight line portion 16B. Thus, blow-by gas that has passed the straight line portion 16B at the outer periphery of the valve section 16 of the flap 14 (the arrow W2 in FIG. 5) flows toward the opposing straight line portion 40B of the impact wall 40 without being dispersed in the peripheral direction of the semicircular arc portions 40A, unlike the flow of gas at the semicircular arc portions 40A (the arrow W3 in FIG. 5), thereby enabling a reduction in the flow speed of the blow-by gas prior to striking the straight line portion 40B of the impact wall 40 to be suppressed. Thus, the blow-by gas for which a reduction in flow speed has been suppressed strikes the straight line portion 40B of the impact wall 40, thereby improving performance in capturing oil mist.

Note that, in cases in which the surface area of the valve section 16 of the flap 14 is uniform, and the shape of the valve section 16 is rectangular with straight line portions about the entire outer periphery thereof, there is an increase in the pressure loss in the flow of gas when the valve section 16 is opened. Thus, by configuring the valve section 16 in a substantially elliptical shape including the straight line portion 40B in the oil separator 10 of the present exemplary embodiment, the pressure loss in the flow of gas is reduced, and performance in capturing oil mist can be improved. Since the configuration is not one in which respective distances between the valve section 16 of the flap 14, and the impact wall 40 and the impact wall 41 is decreased to improve performance in capturing oil mist, the pressure loss in the flow of gas is reduced and performance in capturing oil mist is improved, while securing tolerance (the difference between a maximum dimension and minimum dimension permitted while machining).

In the oil separator 10 of the present exemplary embodiment, the valve section 16 of the flap 14 includes the straight line portion 16B at the upper side outer peripheral portion thereof, and the straight line portion 40B is formed at the upper side outer peripheral portion of the impact wall 40 of the frame section 27 in the oil separator main body 12. This enables an up-down direction dimension of the oil separator 10 to be made smaller. This also enables an up-down direction dimension of the engine head cover 29 in which the oil separator 10 is disposed to be made smaller.

In the oil separator 10 of the present exemplary embodiment, the fixing section 18 of the flap 14 is formed at a location of the outer peripheral portion of the valve section 16 at the opposite side to the straight line portion 16B. Thus, when the valve section 16 of the flap 14 has been pressed open by the flow of gas (the arrow W2 in FIG. 5), the straight line portion 16B of the valve section 16 that opposes the fixing section 18 opens wider than other locations at the outer peripheral portion, and the flow of gas (the arrow W2 in FIG. 5) is greater than the flow of gas at other locations at the outer peripheral portion (the arrows W3, W4 in FIG. 5). Thus, efficiency in capturing oil mist is further improved by having the straight line portion 16B of the valve section 16 at the location opposing the fixing section 18 of the flap 14.

In the oil separator 10 of the present exemplary embodiment, the left and right pair of the two coupling sections 20 project out from the valve section 16 of the flap 14 toward the fixing section 18 with a separation in the left-right direction therebetween, and the impact wall 41 is also formed at an inner portion of the cutout 22 formed between the coupling sections 20. Thus, when the valve section 16 of the flap 14 has been pressed open by the flow of gas, the flow of gas that has flowed out between the two coupling sections 20 impacts the impact wall 41, such that oil mist is captured. Thus, performance in capturing oil mist is further improved.

In the oil separator 10 of the present exemplary embodiment, the flow of gas (the arrow W1 in FIG. 5) presses open and flows through the valve section 16 of the flap 14 disposed along the substantially vertical direction and hits the straight line portion 40B of the impact wall 40 disposed along the substantially horizontal direction, such that oil is captured. Oil captured at the impact wall 40 and the impact wall 41 (the arrow S1 in FIG. 5) drops under its own weight, and is discharged through the left and right pair of opening sections 50 formed at a lower portion of the impact wall 40 to be recovered from the drain valve 54. Recovery of oil is therefore easy.

In the present exemplary embodiment, the oil separator 10 can be fixed to an inner portion of the engine head cover 29 by engaging the engagement portion 27A formed to an outer peripheral portion of the oil separator main body 12 with the engine head cover 29. This enables the oil separator 10 to be easily disposed inside the engine head cover 29.

Other Exemplary Embodiments

Figure 6:
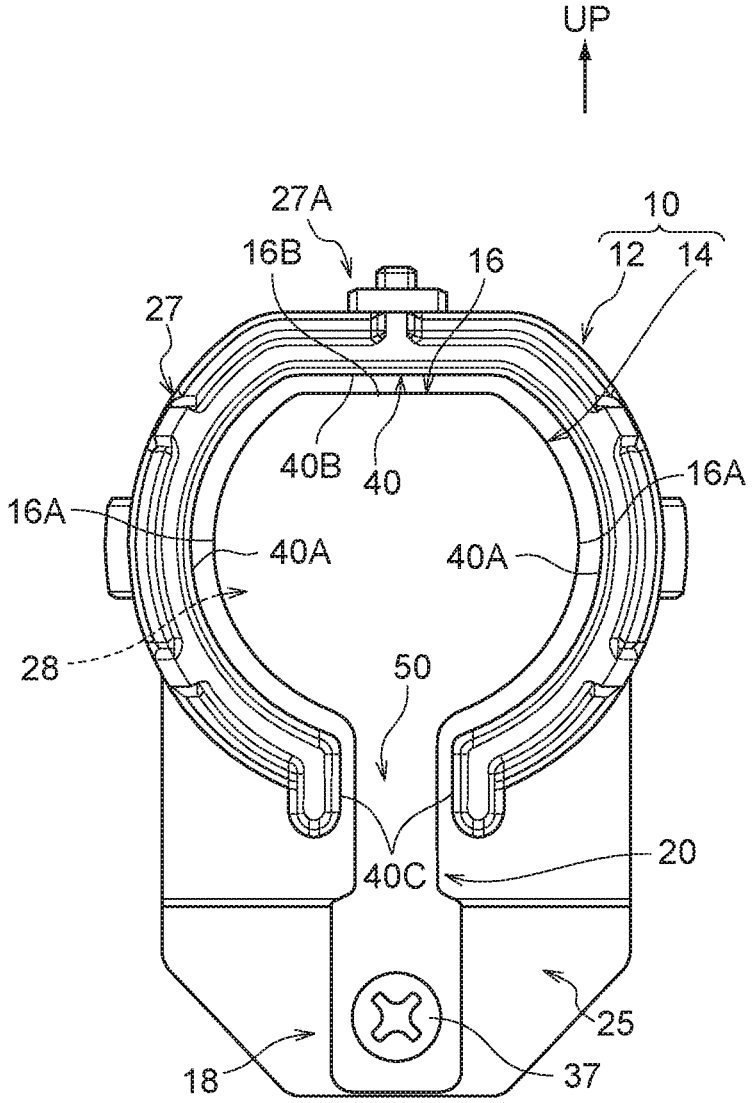
FIG. 6 is a face-on view illustrating an oil separator according to another exemplary embodiment of the present invention.

The present invention has been explained in detail above with reference to a particular exemplary embodiment; however, the present invention is not limited to the above exemplary embodiment, and it would be obvious to a skilled practitioner that various other exemplary embodiments may be implemented within a range of the present invention. For example, in the above exemplary embodiment, the straight line portion 16B of the flap 14, the straight line portion 40B of the impact wall 40, and the impact wall 41 are each configured in a straight line; however, the straight line portion 16B, the straight line portion 40B, and the impact wall 41 may each be configured in a substantially straight line shape that is close to a straight line, but curves slightly. In the above exemplary embodiment, the valve section 16 of the flap 14 has a substantially elliptical shape as an example of a substantially circular shape; however, as in another exemplary embodiment illustrated in FIG. 6, the shape of the valve section 16 of the flap 14 may instead be a shape including the straight line portion 16B at a portion of a circular shaped outer periphery as an example of a substantially circular shape. Three or more of the coupling sections 20 may also be provided.

The oil separator of the present invention may be applied as a separator disposed in an inner portion of a head cover of an automobile engine in order to separate oil contained in blow-by gas generated in an inner portion of the automobile engine, or may be applied to an internal combustion engine other than an automobile engine. The oil separator of the present invention may be provided to a component, other than the head cover, partway along the flow path of the blow-by gas.

The entire content of the disclosure of Japanese Patent Application No. 2013-264479 filed Dec. 20, 2013 is incorporated by reference in the present specification. [0052]

All publications, patent applications and technical standards mentioned in the present specification are incorporated by reference in the present specification to the same extent as if the individual publication, patent application, or technical standard was specifically and individually indicated to be incorporated by reference.

The invention claimed is:

1. An oil separator comprising:

an oil separator main body that is formed with a gas flow path between a gas introduction port that introduces blow-by gas and a gas discharge port that discharges the blow-by gas;

a flap that is provided extending along a direction orthogonal to the gas flow path, that opens and closes the gas flow path, and that includes a circular shaped valve section including a straight line portion of a straight line shape at a portion of an outer periphery of the valve section, wherein a fixing section for fixing the flap to the gas flow path is formed at a location at an opposite side of the flap from the straight line portion; and a first impact wall for capturing oil, that is provided along the outer periphery of the valve section at a downstream side of the valve section in the gas flow path, that includes a straight line portion of a straight line shape along the straight line portion of the valve section, and that is impacted by the blow-by gas flowing out from a peripheral edge of the valve section.

2. The oil separator of claim 1, wherein:

the valve section and the fixing section are coupled together by two coupling sections that project out from the valve section toward the fixing section and that are separated along an outer peripheral direction of the valve section; and a second impact wall is formed in a straight line shape at a location corresponding to somewhere between the two coupling sections.

3. The oil separator of claim 1, wherein:

the valve section of the flap is disposed along a vertical direction;

the straight line portion of the first impact wall is disposed along a horizontal direction; and an opening section for discharging captured oil is formed below the first impact wall.

4. The oil separator of claim 1, further comprising an attachment portion that is formed at an outer peripheral portion of the oil separator main body and that is fixed to an inner portion of an engine head cover.

5. The oil separator of claim 1, wherein:

the valve section of the flap is disposed along a vertical direction;

the straight line portion of the first impact wall is disposed along a horizontal direction; and an opening section for discharging captured oil is formed below the first impact wall.

6. The oil separator of claim 2, wherein:

the valve section of the flap is disposed along a vertical direction;

the straight line portion of the first impact wall is disposed along a horizontal direction; and an opening section for discharging captured oil is formed below the first impact wall.

7. The oil separator of claim 1, further comprising an attachment portion that is formed at an outer peripheral portion of the oil separator main body and that is fixed to an inner portion of an engine head cover.

8. The oil separator of claim 2, further comprising an attachment portion that is formed at an outer peripheral portion of the oil separator main body and that is fixed to an inner portion of an engine head cover.

9. The oil separator of claim 3, further comprising an attachment portion that is formed at an outer peripheral portion of the oil separator main body and that is fixed to an inner portion of an engine head cover.

10. The oil separator of claim 5, further comprising an attachment portion that is formed at an outer peripheral portion of the oil separator main body and that is fixed to an inner portion of an engine head cover.

11. The oil separator of claim 6, further comprising an attachment portion that is formed at an outer peripheral portion of the oil separator main body and that is fixed to an inner portion of an engine head cover.

12. The oil separator of claim 1, wherein the circular shaped valve section including a straight line portion of a straight line shape at a portion of an outer periphery of the valve section is in a plane existing in the direction orthogonal to the gas-flow direction.

13. The oil separator of claim 1, wherein the circular shaped valve section including a straight line portion of a straight line shape at a portion of an outer periphery of the valve section is the outer periphery of the flap in a plane existing in the direction orthogonal to the gas-flow direction.

14. The oil separator of claim 1, wherein the circular shaped valve section including a straight line portion of a straight line shape at a portion of an outer periphery of the valve section is the outer periphery of the flap as viewed from the gas-flow direction.

15. The oil separator of claim 1, wherein the circular shaped valve section including a straight line portion of a straight line shape at a portion of an outer periphery of the valve section is a longest dimension of the flap.

16. The oil separator of claim 1, wherein the outer periphery of the valve section of the flap includes a straight line portion and a circular arc portion, and the first impact wall has a shape corresponding to the outer periphery of the valve section of the flap.

* * * * *